US007080971B2

(12) United States Patent
Wilson et al.

(10) Patent No.: US 7,080,971 B2
(45) Date of Patent: Jul. 25, 2006

(54) COOLED TURBINE SPAR SHELL BLADE CONSTRUCTION

(75) Inventors: Jack W. Wilson, Palm Beach Gardens, FL (US); Wesley Brown, Jupiter, FL (US)

(73) Assignee: Florida Turbine Technologies, Inc., Supitek, FL (US)

( * ) Notice: Subject to any disclaimer, the term of this patent is extended or adjusted under 35 U.S.C. 154(b) by 0 days.

(21) Appl. No.: 10/793,641

(22) Filed: Mar. 4, 2004

(65) Prior Publication Data

US 2006/0120869 A1 Jun. 8, 2006

Related U.S. Application Data

(60) Provisional application No. 60/454,120, filed on Mar. 12, 2003.

(51) Int. Cl.
*F01O 5/18* (2006.01)

(52) U.S. Cl. ..... 416/92; 416/96 A; 416/97 R

(58) Field of Classification Search ..... 416/92, 416/96 R, 96 A, 97 R, 226; 415/115, 116
See application file for complete search history.

(56) References Cited

U.S. PATENT DOCUMENTS

| | | | | | |
|---|---|---|---|---|---|
| 4,257,737 | A * | 3/1981 | Andress et al. | ..... | 416/97 R |
| 4,321,010 | A * | 3/1982 | Wilkinson et al. | ..... | 416/96 A |
| 4,473,336 | A * | 9/1984 | Coney et al. | ..... | 416/96 A |
| 4,563,125 | A * | 1/1986 | Boudigues et al. | ..... | 416/97 R |
| 4,753,575 | A * | 6/1988 | Levengood et al. | ..... | 416/97 R |
| 5,476,364 | A * | 12/1995 | Kildea | ..... | 416/96 R |
| 5,700,131 | A * | 12/1997 | Hall et al. | ..... | 416/97 R |
| 6,422,819 | B1 * | 7/2002 | Tsai et al. | ..... | 416/97 R |

* cited by examiner

*Primary Examiner*—Christopher Verdier
(74) *Attorney, Agent, or Firm*—Norman Friedland

(57) ABSTRACT

A blade for a rotor of a gas turbine engine is constructed with a spar and shell configuration. The spar is constructed in an integral unit or multi-portions and includes a first wall adjacent to the pressure side and a second wall adjacent to the suction side, a tip portion extending in the spanwise direction and extending beyond the first wall and the second wall and a root portion extending longitudinally, an attachment portion having a central opening for receiving the root portion and a platform portion. The root portion fits into the central opening and is secured therein by a pin extending transversely through the attachment and the root portion. The shell fits over the spar and is supported thereto by a plurality of complementary hooks extending from the spar and shell. The ends of the shell fit into grooves formed on the tip portion and the platform.

27 Claims, 4 Drawing Sheets

COOLED TURBINE SPAR SHELL BLADE CONSTRUCTION

This application claims benefit of a prior filed co-pending U.S. provisional application Ser. No. 60/454,120, filed on Mar. 12, 2003, entitled "COOLED TURBINE BLADE by Jack Wilson and Wesley Brown.

FEDERALLY SPONSORED RESEARCH

None

TECHNICAL FIELD

This invention relates to internally cooled turbine blades for gas turbine engines and more particularly to the construction of the internally cooled turbine comprising a spar and shell construction.

BACKGROUND OF THE INVENTION

As one skilled in the gas turbine technology recognizes, the efficiency of the engine is enhanced by operating the turbine at a higher temperature and by increasing the turbine's pressure ratio. Another feature that contributes to the efficacy of the engine is the ability to cool the turbine with a lesser amount of cooling air. The problem that prevents the turbine from being operated at higher temperatures is the limitation of the structural integrity of the turbine component parts that are jeopardized in its high temperature, hostile environment. Scientist and engineers have attempted to combat the structural integrity problem by utilizing internal cooling and selecting high temperature resistance materials. The problem associated with internal cooling is twofold. One, the cooling air that is utilized for the cooling comes from the compressor that has already expended energy to pressurize this air and the spent air in the turbine cooling process in essence is a deficit in engine efficiency. The second problem is that the cooling is through cooling passages and holes that are in the turbine blade which, obviously, adversely affects the blade's structural prowess. Because of the tortuous path that is presented to the cooling air, the pressure drop that is a consequence thereof, requires higher pressure and more air to perform the cooling that would otherwise take a lesser amount of air given the path becomes less tortuous to the cooling air. While there are materials that are available and can operate at a higher temperature that is heretofore been used, the problem is how to harness these materials so that they can be used efficaciously in the turbine environment.

To better appreciate these problems it would be worthy of note to recognize that traditional blade cooling approaches include the use of cast nickel based alloys with load-bearing walls that are cooled with radial flow channels and re-supply holes in conjunction with film discharge cooling holes. Example of these types of blades are exemplified by the following patents that are incorporated herein by reference.

- U.S. Pat. No. 4,257,737 granted to D. E. Andress et al on Mar. 24, 1981 entitled "Cooled Rotor Blade";
- U.S. Pat. No. 4,753,575 granted to J. L. Levengood et al on Jun. 28, 1988 entitled "Airfoil with Nested Cooling Channels";
- U.S. Pat. No. 5,476,364 granted to R. J. Kildea on Dec. 19, 1995 entitled "Tip Seal and Anti-Contamination for Turbine Blades"; and
- U.S. Pat. No. 5,700,131 granted to Hall et al on Dec. 23, 1997 entitled "Cooled Turbine Blades for a Gas Turbine Engine".

Also well known by those skilled in this technology is that the engine's efficiency increases as the pressure ratio of the turbine increases and the weight of the turbine decreases. Needless to say these parameters have limitations. Increasing the speed of the turbine also increases the airfoil loadings and, of course, satisfactory operation of the turbine is to stay within given airfoil loadings. The airfoil loadings are governed by cross sectional area of the airfoil of the turbine multiplied by the velocity of the tip of the turbine squared. Obviously, the rotational speed of the turbine has a significant impact on the loadings.

The spar/shell construction contemplated by this invention affords the turbine engine designer the option of reducing the amount of cooling air that is required in any given engine design and in addition, allowing the designer to fabricate the shell from exotic high temperature materials that heretofore could not be cast or forged to define the surface profile of the airfoil section. In other words, by virtue of this invention, the skin can be made from Niobium or Molybdenum or their alloys, where the shape is formed by a well known electric discharge process (EDM) or a wire EDM process. In addition, because of the efficacious cooling scheme of this invention, the shell portion could be made from ceramics, or more conventional materials and still present an advantage to the designer because a lesser amount of cooling air would be required.

SUMMARY OF THE INVENTION

An object of this invention is to provide a turbine rotor for a gas turbine engine that is constructed with in a spar/shell configuration.

A feature of this invention is a inner spar that extends from the root of the blade to the tip and is joined to the attachment at the root by a pin or rod or the like.

Another feature of this invention is that the shell and/or spar can be constructed from a high temperature material such as ceramics, Molybdenum or Niobium (columbium) or a lesser temperature resistive material such as Inco 718, Waspaloy or the well known single crystal material currently being used in gas turbine engines. For existing types of engine designs where it is desirable of providing efficacious turbine blade cooling with the use of compressor air at lower amounts and obtaining the same degree of cooling. For advanced engine designs where it is desirable to utilize more exotic materials such as Niobium or Molybdenum the shell and spar can be made out of these materials or the spar can be made from a lesser exotic material that is more readily cast or forged.

The material of the shell may be taken from a group consisting of stainless steel, molybdenum, niobium, ceramics, molybdenum alloys, or niobium alloys. The material of the spar may be taken from a group consisting of stainless steel, molybdenum, niobium, ceramics, molybdenum alloys, or niobium alloys.

Another feature of this invention for engine designs that require higher turbine rotational speeds, the spar can be made form a dual spar system where the outer spar extends a shorted distance radially relative to the inner spar and defines at the junction a mid span shroud and the shell is formed in an upper section and a lower section where each section is joined at the mid span shroud. The pin in this arrangement couples the inner spar and outer spar at the attachment formed at the root of the blade. This design can utilized the same materials that are called out in the other design.

A feature of this invention is an improved turbine blade that is characterized as being easy to fabricate, provide efficacious cooling with lesser amounts of cooling air than heretofore known designs, provides a shell or shells that can be replaced and hence affords the user the option of repair or replace. The materials selected can be conventional or more esoteric depending on the specification of the engine.

The foregoing and other features of the present invention will become more apparent from the following description and accompanying drawings.

Figure 1:
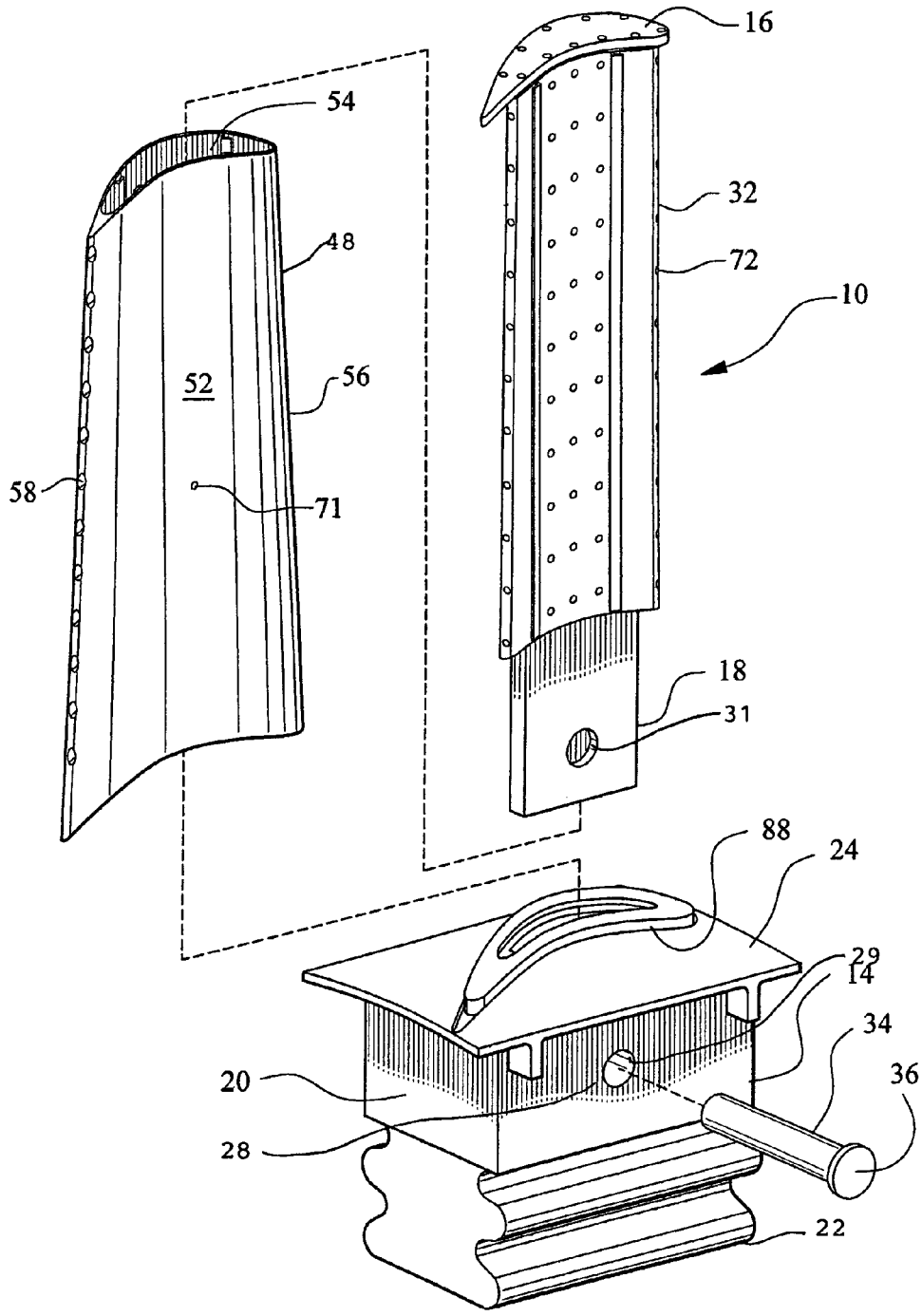
FIG. 1 is an exploded view in perspective showing the details of one embodiment of this invention.

These figures merely serve to further clarify and illustrate the present invention and are not intended to limit the scope thereof.

DETAILED DESCRIPTION OF THE INVENTION

While this invention is described in its preferred embodiment in two different, but similar configurations so as to take advantage of engine's that are designed at higher speeds than are heretofore encountered, this invention has the potential of utilizing conventional materials and improving the turbine rotor by enhancing its efficiency by providing the desired cooling with a lesser amount of compressor air, and affords the designer to utilize a more exotic material that has higher resistance temperatures while also maintaining the improved cooling aspects. Hence, it will be understood to one skilled in this technology, the material selected for the particular engine design is a option left open to the designer while still employing the concepts of this invention. For the sake of simplicity and convenience only a single blade in each of the embodiments is described although one skilled in this art that the turbine rotor consists of a plurality of circumferentially spaced blades mounted in a rotor disk that makes up the rotor assembly.

This disclosure is divided into two embodiments employing the same concept of a spar and shell configuration of a turbine blade, where one of the embodiments includes a single spar and the other embodiment includes a double spar to accommodate higher turbine rotational speeds. FIGS. 1 through 4 are directed to one of the embodiments of a turbine blade generally illustrated as reference numeral 10 as comprising a spar generally elliptical shaped spar 12 extending longitudinally or in the radially direction from the root portion 14 to the tip 16 with a downwardly extending portion 18 that fairs into a rectangularly shaped projection 26 that is adapted to fit into the attachment 20. The spar 12 spans the camber stations extending along the airfoil section defined by the shell 28. The attachment 20 may include a fir tree attachment portion 22 that fits into a complementary fir tree slot formed in the turbine disk (not shown). The attachment 20 may be formed with the platform 24 or the platform may be formed separately and joined thereto and projects in the circumferential direction to abut against the platform in the adjacent blade in the turbine disk. A seal, such as a feather seal (not shown), may be mounted between platforms of adjacent blades to minimize or eliminate leakage around the individual blades.

The spar may be formed as a single unit or may be made up in complementary parts and as for example it may be formed in two separate portions that are joined at the parting plane along the leading edge facing portion 30 and trailing edge facing portion 32 and extending the longitudinal axis 31. Spar 12 is attached to the attachment 20 by the pin 34 which fits through the hole 29 in the attachment 20 and the aligned hole 31 formed in the extending portion 18. Pin 34 carries the head 36 that abuts against the face 38 of the attachment 20 and includes the flared out portion 40 at the opposing end of head 36. This arrangement secures the spar 12 and assures that the load on the blade 10 is transmitted from the airfoil section though the attachment 20 to the disk (not shown). The tip of blade may be sealed by a cap 44 that may be formed integrally with the spar 12 or may be a separate piece that is suitably joined to the top end of the spar 12. It should be appreciated that this design can accommodate a squealer cap, if such is desired. The material of the spar will be predicated on the usage of the blade and in a high temperature environment the material can be a molybdenum or niobium and in a lesser temperature environment the material can be a stainless steel like Inco 718 or Waspaloy or the like.

Shell 48 extends over the surface of the spar 12 and is hollow in the central portion 50 and spaced from the outer surface of spar 12. The shell defines the pressure side 52, the suction side 54, the leading edge 56 and the trailing edge 58. As mentioned in the above paragraph the shell 48 may be made from different materials depending on the specification of the gas turbine engine. In the higher temperature requirements, the shell preferably will be made from Molybdenum or Niobium and in a lesser temperature environment the shell 48 may be made from conventional materials. If the material selected cannot be cast or forged, then the shell will be made from a blank and the contour will be machined by a wire EDM process. The shell can be made in a single unit or can be made into two halves divided along the longitudinal axis, similar to the spar 12. As best seen in FIG. 1, the attachment 20 is made to include a stud portion 88 that complements the contoured surface of spar 12 and the contoured surface of shell 48. Additionally the shell 48 and spar 12 carry complementary male and female hooks 60 and 62. The top edge 80 of shell 48 is supported by the cap 44 and fits into an annular groove 82 so that the upper edge 84 of shell 48 bears against the shoulder 86. The lowered edge 88 fits into an annular complementary groove 90 formed on the upper edge of platform 24 and bears against the opposing surfaces of the groove 90 and the outer surface of the attachment 20.

As mentioned in the above paragraphs, one of the important features of this invention is that it affords efficacious cooling, i.e. cooling that requires a lesser amount of air. This can be readily seen by referring to FIG. 3. As shown the cooling air is admitted through the inlet 66, the central opening formed in the spar 12 at the bottom face 68 of the attachment 20, and flows in a straight passage or cavity 70 without having to flow through tortuous paths. The air that is admitted into cavity 70 flows out of the feed holes 72 into the space or cavity 74 defined between the spar 12 and the shell 48. Again, there are virtually no tortuous passages that are typically found in heretofore known designs and hence the pressure drop is decreased requiring lesser amount of air at a lower pressure, all of which enhances the cooling efficiency of the blade. The air from the feed holes 72, that may be formed integrally in the spar or drilled therein, can serve to impinge on the inner wall of the shell 48 but primarily feeds the space 74. It should be understood that this design can include film cooling holes (as for example holes 71 and 73) formed in the shell 48 on both the pressure surface 52 and the suction surface 54 and may also include a shower head (depicted as holes 75) on the leading edge and cooling holes (depicted as 77) on the trailing edge 58. The design and number of all of these cooling holes i.e. shower head, film cooling, feed holes and the like are predicated on the particular specification of the engine.

Figure 2:
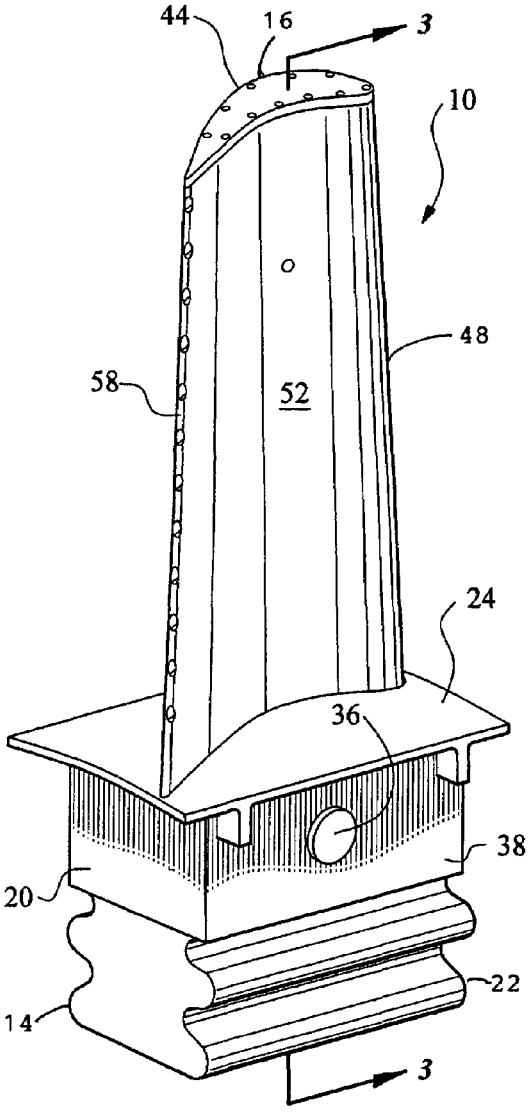
FIG. 2 is a perspective view illustrating the assembled turbine blade of the embodiment depicted in FIG. 1 of this invention.
Figure 3:
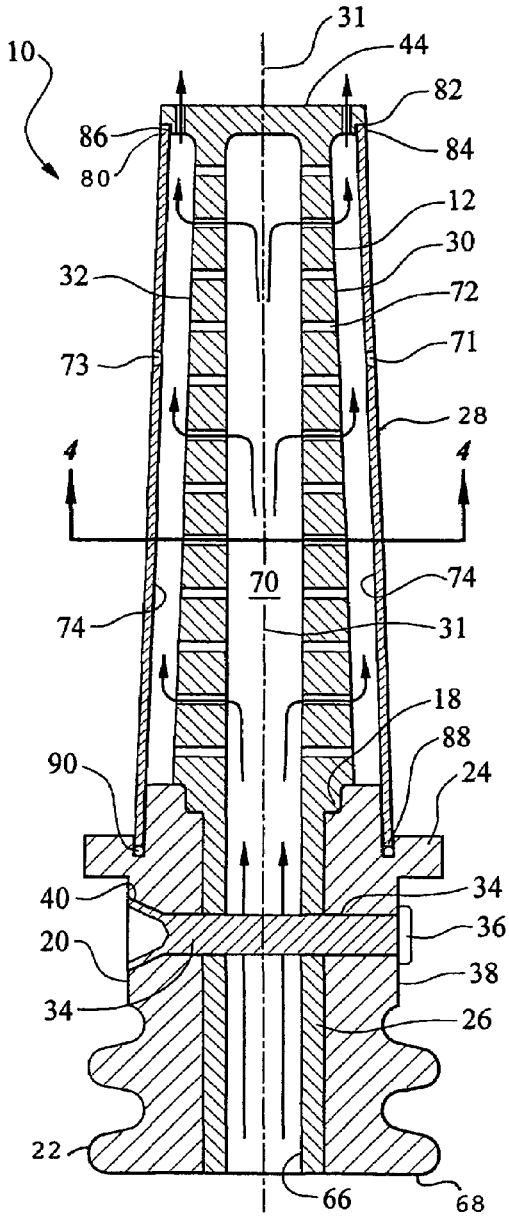
FIG. 3 is a section taken from sectional lines 3—3 of FIG. 2.
Figure 4:
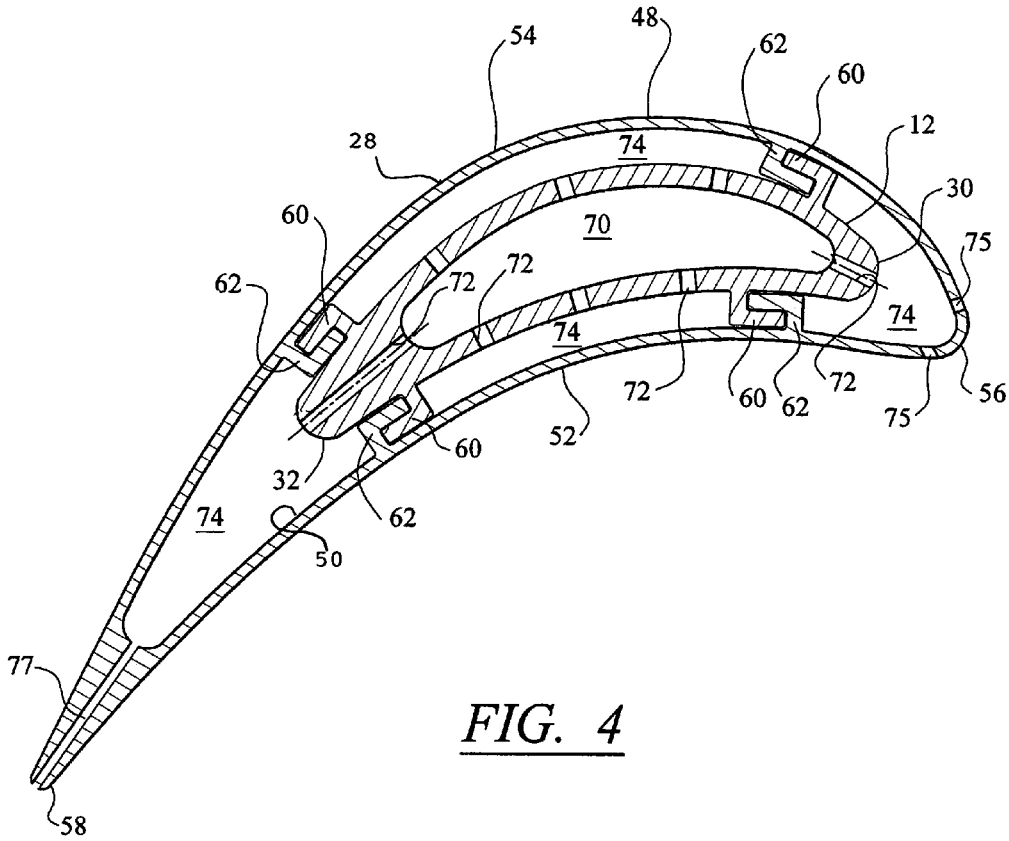
FIG. 4 is a section taken along the sectional lines 4—4 of FIG. 3 illustrating the attachment of the shell to the strut of this invention.
Figure 5:
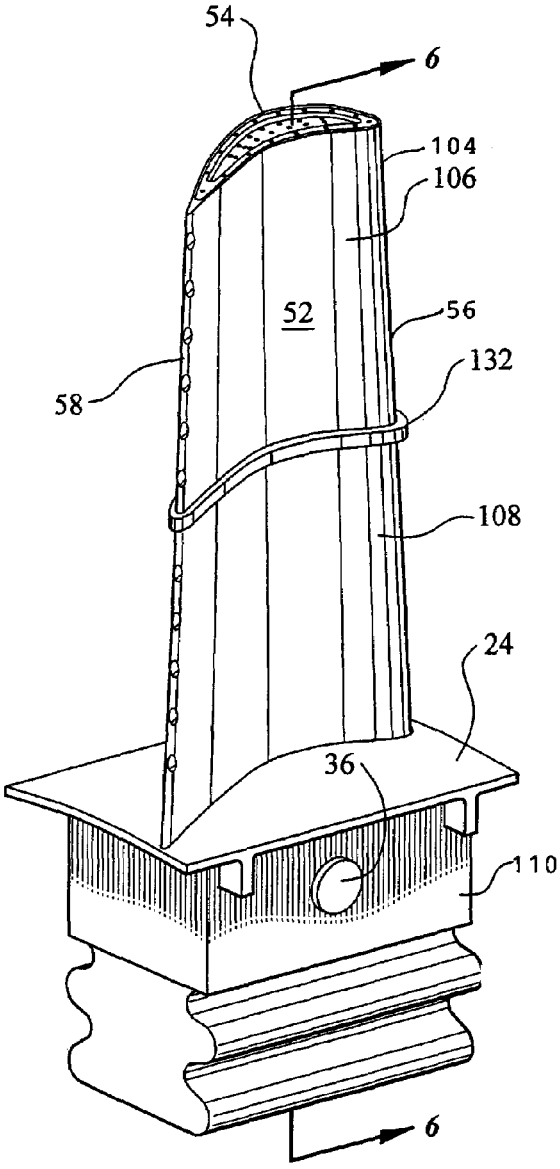
FIG. 5 is a perspective view illustrating a second embodiment of this invention.
Figure 6:
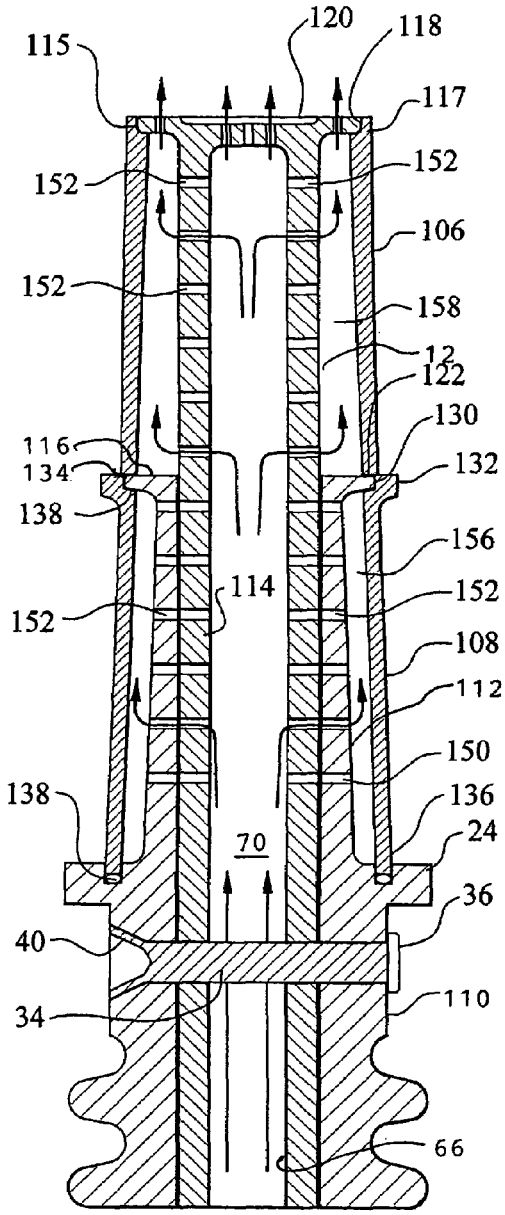
FIG. 6 is a section view in elevation taken along the sectional lines of 6—6 of FIG. 5.

The other embodiment depicted in FIGS. 5 and 6 is similarly constructed and is adapted to handle a higher rotational speed of the turbine. In this embodiment the shell 104 that is equivalent to shell 48 depicted in FIGS. 1–4 is formed into two halves, the upper halve 106 and the lower halve 108 and the attachment 110 that is equivalent to the attachment 20 is extended in the longitudinal and upwardly direction to extend almost midway along the airfoil portion of the blade to form another spar 112. This spar 112 surrounds the lower portion 114 of spar 12 (like numerals in all the Figs. depict like or similar elements) and is contiguous thereto along its inner surface. A ledge or platen 116 is formed integrally therewith at the top end and extends in the spanwise direction. Shell 106 and shell 108 are formed in an elliptical-like shape to define the airfoil for defining the pressure surface 52, suction surface 54, leading edge 56 and trailing edge 58. A groove 115 formed at the upper edge 117 of shell 106 bears against the outer edge 118 of cap 120 which is the equivalent to cap 16 of FIGS. 1–3 except it is a squealer cap. Obviously, when the blade is rotating the shell 106 is loaded against the cap 120 and this force is transmitted to the disk via the spar 12 and lower portion 114. The lower edge 122 bears against the platen 116 and can be suitably attached thereto by a suitable braze or weld. The lower shell 108 is similarly formed like shell 106 and defines the lower portion of the airfoil. Lower shell 108 includes the groove 130 formed in the increased diameter portion 132 of shell 108 and serves to receive the outer edge 134 of platen 116. The lower edge 136 of shell 108 fits into an annular groove 138 formed in the platform 24. While not shown in these Figs. the male and female hooks associated with the spar and shell is also utilized in this embodiment and this portion of the drawings are incorporated herein by reference. The stud is like the embodiment depicted in FIGS. 1–3 is affixed to the attachment via pin 34.

The cooling arrangement of the embodiment depicted in FIGS. 5 and 6 is almost identical to the cooling configuration of the embodiment depicted in FIGS. 1–4. The only difference is that since the platen 116 forms a barrier between the upper shell 106 and lower shell 108, the cooling air to the lower portion of the airfoil is directed from the inlet 66 and passage 70 via the radially spaced holes 150 consisting of the aligned holes in the spars 12 and lower portion 114 that feeds space 156, and the holes 152 formed in the upper portion of the spar 12 that feed the space 158. As is the case with the embodiment of FIGS. 1–4, the shell may include a shower head at the leading edge, cooling passages at the trailing edge, holes at the tip for cooling and discharging dirt and foreign particles in the coolant and film cooling holes at the surface of the pressure side and suction side.

Although this invention has been shown and described with respect to detailed embodiments thereof, it will be appreciated and understood by those skilled in the art that various changes in form and detail thereof may be made without departing from the spirit and scope of the claimed invention.

The invention claimed is:

1. A blade for a rotor of a gas turbine engine, said blade having a longitudinal axis and a spanwise axis, said blade including a spar having a wall being generally elliptically shaped extending along said longitudinal axis and said spanwise axis and defining a central cavity, an attachment having a central bore disposed at the bottom portion of said spar, a depending portion extending longitudinally and downwardly from said wall fitting into said central bore, an attachment member extending laterally through openings formed in said attachment and said depending portion securing said spar to said attachment, a relatively thin aerodynamically shaped shell extending over said spar defining an airfoil and laterally spaced from said spar defining another longitudinal cavity, said shell having an upper edge attached to the upper end of said spar and a lower edge attached to said attachment, and support means on said shell and said spar supporting said shell to said spar and defining a load transmitting path for transmitting loads on said shell through said spar to said attachment, and a coolant flowing from the end of said spar through the central cavity and through holes in said spar to said another longitudinal cavity between said shell and said spar.

2. A blade for a rotor of a gas turbine engine as claimed in claim 1 wherein said attachment includes a platform portion extending laterally and circumferentially, said lower edge of said shell fitting into an annular groove formed in said platform.

3. A blade for a rotor of a gas turbine engine as claimed in claim 2 including an inner surface on said shell and an outer surface on said spar, wherein said support means includes a plurality of spanwise spaced female hooks on the inner surface of said shell and a plurality of complementary spanwise spaced male hooks on the outer surface of said spar.

4. A blade for a rotor of a gas turbine engine as claimed in claim 2 wherein said support means includes a plurality of additionally spanwise spaced female hooks and spanwise spaced male hooks extending longitudinally.

5. A blade for a rotor of a gas turbine engine as claimed in claim 1 wherein said airfoil includes a leading edge and a trailing edge, said spar includes a first longitudinal and spanwise extending wall having longitudinally extended edges facing the leading edge and longitudinally extended edges facing the trailing edge and a second longitudinal and spanwise extending wall having longitudinally extended edges facing the leading edge and longitudinally extended edges facing the trailing edge said second wall being joined at the edges of said first longitudinal and spanwise extending wall.

6. A blade for a rotor of a gas turbine engine as claimed in claim 5 wherein said shell includes a pressure surface and a suction surface and cooling holes formed in said spar and said shell to flow coolant through shower head holes formed in said leading edge and passages formed in said trailing edge and film cooling holes formed in said pressure surface and said suction surface.

7. A blade for a rotor of a gas turbine engine as claimed in claim 6 wherein said attachment member includes a pin having a head on one end and a flared portion on the other end.

8. A blade for a rotor of a gas turbine engine as claimed in claim 7 wherein said spar includes a top cap portion of said spar defining the tip of said blade and a groove formed in the outer edge of said top cap portion for receiving the upper edge of said shell.

9. A blade for a rotor of a gas turbine engine as claimed in claim 8 wherein said top cap portion is formed integrally with said spar.

10. A blade for a rotor of a gas turbine engine as claimed in claim 9 wherein the material of said shell is taken from a group consisting of stainless steel, molybdenum, niobium, ceramics, molybdenum alloys, or niobium alloys, and can be single crystal.

11. A blade for a rotor of a gas turbine engine as claimed in claim 9 wherein the material of said spar is taken from a group consisting of stainless steel, molybdenum, niobium, ceramics, molybdenum alloys, or niobium alloys, and can be single crystal.

12. A blade construction comprising a spar member and a shell member, said blade having a tip portion, a root portion, a leading edge, a trailing edge, a pressure surface and a suction surface, said spar having a first longitudinally extending wall spaced from said pressure surface and a second longitudinally extending wall spaced from said suction surface defining a longitudinally extending cavity, an attachment having a platform, an elongated depending portion extending downwardly from said first longitudinally extending wall and said second longitudinally extending wall into a central bore formed in said attachment, a pin extending through opposing openings formed in said attachment and opposing openings formed in said elongated depending portion securing said spar to said attachment, a tip portion extending laterally at the tip edge of said first longitudinally extending wall and said second longitudinally extending wall, said shell defining said pressure surface and said suction surface, said leading edge and said trailing edge of said blade supported to said tip portion and said platform and support means on said shell and on said spar supporting said shell to said spar and said shell and said spar being spaced to define another longitudinally extending cavity, said support means for transmitting loads from said shell through said spar to said attachment and coolant from said opening in said attachment communicating with said cavity and said another longitudinally extending cavity for cooling said spar and shell.

13. A blade construction as claimed in claim 12 wherein said tip portion defines said tip of said blade.

14. A blade construction as claimed in claim 13 wherein said first longitudinally extending wall and said second longitudinally extending wall are integrally formed.

15. A blade construction as claimed in claim 14 wherein said pin includes a head portion on one end of said pin and a flared out portion on an end of said pin remote from said head.

16. A blade for a rotor of a gas turbine engine, said blade having a longitudinal axis and a spanwise axis, said blade including a first spar having a wall being generally elliptically shaped extending along said longitudinal axis and said spanwise axis and defining a central cavity, an attachment having a central bore disposed at the bottom portion of said first spar, a depending portion extending longitudinally and downwardly from said wall fitting into said central bore, an attachment member extending laterally through openings formed in said attachment and said depending portion securing said first spar to said attachment, a second spar extending longitudinally and upwardly from said attachment and having a platen portion intermediate the ends of said first spar and said second spar being contiguous with said first spar, a first aerodynamically shaped shell extending over said first spar defining the an upper airfoil of said blade and laterally spaced from said first spar defining a second longitudinal cavity, a second aerodynamically shaped shell extending from said attachment to adjacent to said platen and defining a lower airfoil of said blade and spaced from said second spar for defining a third longitudinal cavity, said first aerodynamically shaped shell having an upper edge attached to the upper end of said first spar and said second aerodynamically shaped shell having a lower edge attached to said attachment, and support means on said shell and said spar supporting said first aerodynamically shaped shell to said first spar and said second aerodynamically shaped shell to said second spar for defining a load transmitting path for transmitting loads on said first aerodynamically shaped shell and said second aerodynamically shaped shell through said first spar and said second spar to said attachment, and a coolant flowing from the end of said first spar through the central cavity and through holes in said first spar and said second spar to said second longitudinal cavity and said third longitudinal cavity.

17. A blade for a rotor of a gas turbine engine as claimed in claim 16 wherein said attachment includes a platform portion extending laterally and circumferentially, said lower edge of said second shell fitting into an annular groove formed in said platform.

18. A blade for a rotor of a gas turbine engine as claimed in claim 17 including an inner surface on said first said shell and on said second shell and an outer surface on said first spar and on said second spar, wherein said support means includes a plurality of spanwise spaced female hooks on the inner surface of said first shell and on said second shell, and a plurality of complementary spanwise spaced male hooks on the outer surface of said first spar and on said second spar.

19. A blade for a rotor of a gas turbine engine as claimed in claim 18 wherein said support means includes a plurality of additionally spanwise spaced female hooks and spanwise spaced male hooks extending longitudinally.

20. A blade for a rotor of a gas turbine engine as claimed in claim 19 wherein said airfoils defines a leading edge and a trailing edge, said first spar includes a first longitudinal and spanwise extending wall having longitudinally extended edges facing the leading edge and longitudinally extended edges facing the trailing edge and a second longitudinal and spanwise extending wall having longitudinally extended edges facing the leading edge and longitudinally extended edges facing the trailing edge said second wall being joined at the edges of said first longitudinal and spanwise extending wall.

21. A blade for a rotor of a gas turbine engine as claimed in claim 20 wherein said first aerodynamically shaped shell and said second aerodynamically shaped shell includes a pressure surface and a suction surface and cooling holes formed in said first spar and said second spar and said first aerodynamically shaped shell and said second aerodynamically shaped shell to flow coolant through shower head holes formed in said leading edge and passages formed in said trailing edge and film cooling holes formed in said pressure surface and said suction surface.

22. A blade for a rotor of a gas turbine engine as claimed in claim 21 wherein said attachment member includes a pin having ahead on one end and a flared portion on the other end.

23. A blade for a rotor of a gas turbine engine as claimed in claim 22 wherein said spar includes a top cap portion of said first spar defining the tip of said blade and a groove formed in the outer edge of said top cap portion for receiving the upper edge of said first aerodynamically shaped shell.

24. A blade for a rotor of a gas turbine engine as claimed in claim 23 wherein said top cap portion is formed integrally with said first spar.

25. A blade for a rotor of a gas turbine engine as claimed in claim 16 wherein the material of said shell is taken from a group consisting of stainless steel, molybdenum, niobium, ceramics, molybdenum alloys, or niobium alloys.

26. A blade for a rotor of a gas turbine engine as claimed in claim 16 wherein the material of said spar is taken from a group consisting of stainless steel, molybdenum, niobium, ceramics, molybdenum alloys or niobium alloys, and can be single crystal.

27. A blade for a rotor of a gas turbine engine as claimed in claim 16 wherein the second aerodynamically shaped shell includes an outer extending portion circumscribing the platen and defining a mid-span spar of said blade.

* * * * *